US005080266A

United States Patent [19]

O'Neill

[11] Patent Number: 5,080,266

[45] Date of Patent: Jan. 14, 1992

[54] SELF-CHARGING AEROSOL DISPENSER FOR LIQUIDS

[76] Inventor: Paul J. O'Neill, 560 Village Unit 48, P.O. Box 4253, Incline Village, Nev. 98450

[21] Appl. No.: 478,831

[22] Filed: Feb. 2, 1990

[51] Int. Cl.[5] ..... G65D 83/14

[52] U.S. Cl. ..... 222/635; 222/402.1; 239/34; 137/505.36

[58] Field of Search ..... 222/635, 402.1, 399; 239/337, 340; 137/505.39, 505.36

[56] References Cited

U.S. PATENT DOCUMENTS 2,774,374 12/1956 Schneider ..... 137/505.36 X
3,478,933 11/1969 Rousselot ..... 222/635
3,583,604 6/1971 Marand ..... 222/635
3,615,042 10/1971 Marand ..... 222/399 X
4,174,811 11/1979 Binder ..... 222/399 X
4,203,552 5/1980 Hayes ..... 239/337
4,702,396 10/1987 Gwiazda ..... 222/5 X
4,995,533 2/1991 Vandoninck ..... 222/399 X

*Primary Examiner*—Kevin P. Shaver
*Assistant Examiner*—Gregory L. Huson
*Attorney, Agent, or Firm*—Brian C. Kelly

[57] ABSTRACT

A gas-propelled dispensing device for a liquid container has a high pressure vessel and a pressure gas vessel. A pressure reducing valve is provided between the two vessels so that as consumed, replacement gas is supplied to the low pressure chamber at a controlled moderate pressure. A relatively long tube delivers liquid from the bottom of the container, and a gas duct in the discharge head is connected to the low pressure vessel. Both ducts are opened by pressing the discharge head so that gas flows through a venturi passageway to draw liquid from the container which is propelled outward by the gas in a spray. Liquid carbon dioxide is a preferred nontoxic, nonflammable source of the gas propellant.

13 Claims, 2 Drawing Sheets

SELF-CHARGING AEROSOL DISPENSER FOR LIQUIDS

BACKGROUND OF THE INVENTION

Aerosol dispensers have been available for a number of years for application of hair sprays and other personal care products, as well as for paints, lubricants, insecticides and a multitude of other liquid products.

In the earlier days of aerosol marketing, "Freon" blends were widely used as propellants, principally because they were not flammable and were relatively nontoxic. However, in recent years, it was discovered that "Freons" when released into the atmosphere, migrated to the upper stratosphere and contributed to the depletion of ozone. Since ozone shields the surface of the earth against penetration of solar ultraviolet radiation, the use of "Freon" propellants was believed by many to have contributed to climate changes, as well as to an increased incidence of skin cancers and cataracts. Accordingly, the U.S. Environmental Protection Agency (E.P.A.) banned the further use of "Freon" propellants. This forced aerosol packagers to select from three alternative propellant systems, all of which had serious disadvantages. First, were various hydrocarbons, consisting of blends of propane and butane mixtures. However such hydrocarbon propellants are extremely flammable, and are in the chemical class known as volatile organic compounds, which are recognized as a significant cause of lower atmospheric air pollution or smog. Therefore, in even moderately populated areas of the country severe restrictions have been placed on the use of such compounds in many operations. While, because of their size, aerosol packages have generally been exempt so far from such restrictions, there is a growing indication that, at least in a number of highly populated problem areas, their eventual phaseout is inevitable.

A second alternative involves the use of gaseous carbon dioxide as the propellant. Being non-flammable and nontoxic, carbon dioxide gas is an excellent medium for this purpose, but such systems have limited utility because of the relatively small quantity of the pressurized gas that can be accommodated in the head space of the aerosol container. Moreover, limitations of pressure to relatively low maximum allowable safe levels greatly restrict the energy content of the propellant gas, making it suitable for use with just very low viscosity products. Also, as the liquid product and propellant gas are evacuated, the delivery pressure diminishes further, usually resulting in a change in spray pattern.

The third alternative system presently available involves the use of hydrochlorofluorocarbons (HCFC's) and Dimethylether. However, such propellants are extremely expensive and, at least in the case of dimethylether, flammable. Moreover, it is suspected, that such propellants may have some ozone depleting effect.

In addition to the selection of a gas propellant, further problem in the aerosol packaging industry resides in the disposing of the used aerosol containers, particularly for large scale commercial users. After the product has been used up, the container remains charged with the propellant, and where the propellant is a flammable gas, the container is considered hazardous waste, even where the product is a water-based liquid.

Also, in many present systems there is the problem of co-mixing the product and the propellant in a common container. In such case, problems of incompatibility are often encountered, particularly with water-based products.

OBJECTS OF THE INVENTION

It is an object of this invention to provide a liquid dispensing device to be operated with a nontoxic, nonflammable gas propellant, which is self charging for extended life.

It is a further object of this invention to provide a liquid dispensing device using carbon dioxide gas as the propellant, the gas being supplied over an extended life at regulated pressure from a small volume of liquid or highly compressed gaseous, carbon dioxide.

It is a further object of this invention to provide a liquid dispensing device which enables the complete evacuation of a liquid product at a relatively uniform discharge rate.

It is a further object of this invention to provide a device for dispensing an aerosol propellant that will supply gaseous carbon dioxide at a regulated, relatively constant pressure.

It is a further object of this invention to provide a liquid dispenser with a gaseous propellant wherein the liquid product and the gas propellant are kept separated up to the point of delivery at the spray head.

It is a further object of this invention to provide a liquid container with a gas propellant device, which is easily separated from the container at evacuation of the product, for complete disposal of hazardous materials.

Other objects and advantages of this invention will become apparent from the description to follow, particularly when read in conjunction with the accompanying drawing.

SUMMARY OF THE INVENTION

In carrying out this invention, I provide a gas dispensing spray unit which is easily attached to, and separated from, a standard container for liquids and other flowable materials, The unit includes a high pressure liquid chamber that is initially charged with a quantity of liquid carbon dioxide or a highly compressed gas. The high pressure liquid chamber is connected to a low pressure gas chamber through a pressure regulator valve that recharges the low pressure chamber when pressure therein falls below a set level. Both high and low pressure carbon dioxide chambers are in sealed isolation from the liquid product that is carried in the container. A spray head includes a gas flow passageway that opens into the gas chamber and a liquid flow duct that extends down into the liquid product. When the spray head is depressed, it opens valves to allow the previously separated liquid product and the gas propellant to flow up and merge at a venturi discharge opening, whereby the gas propellant projects the liquid product out in a spray.

The spray pattern may be altered for products of differing viscosities by varying the regulated pressure provided by the low pressure gas chamber.

DESCRIPTION OF A PREFERRED EMBODIMENT

Figure 1:
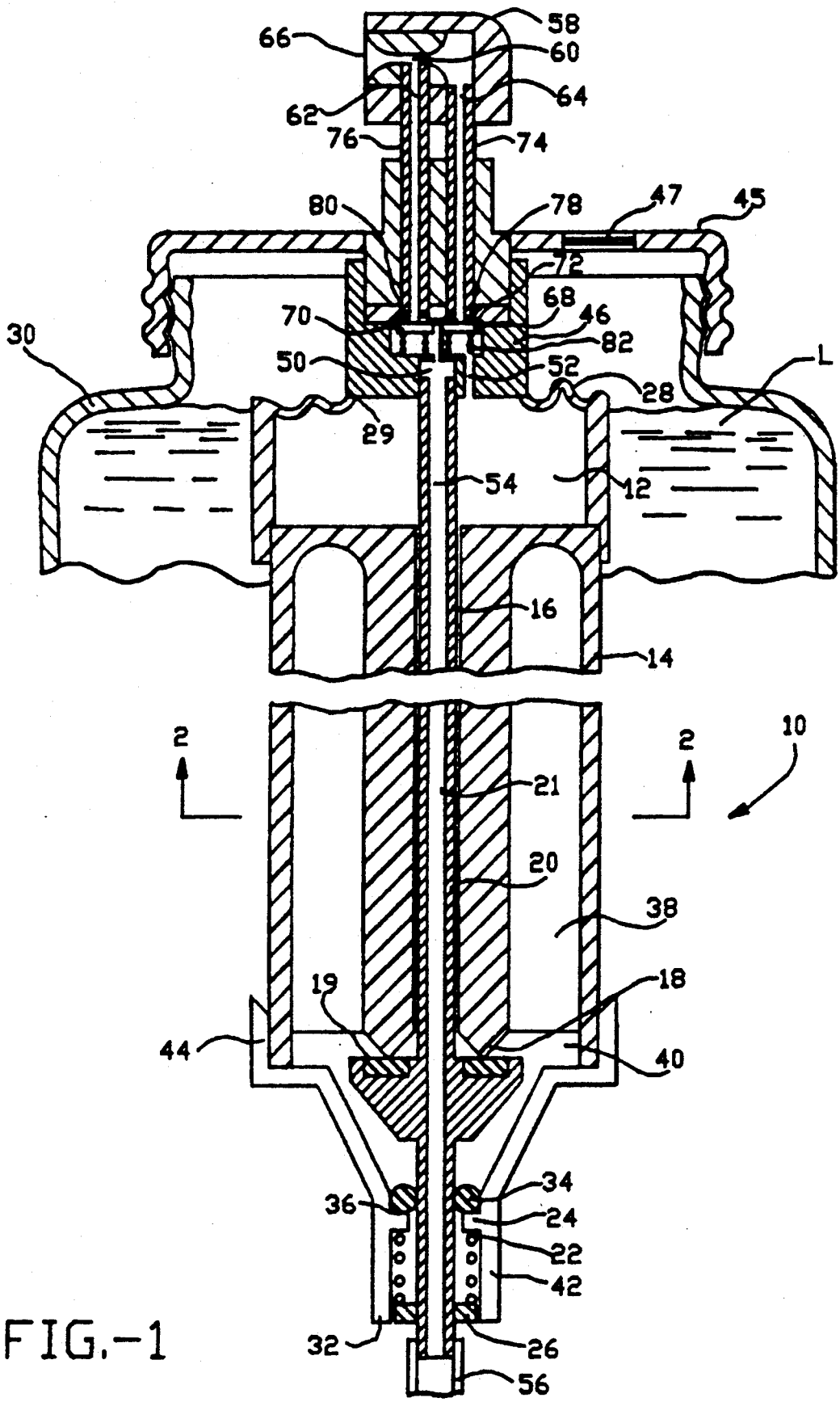
FIG. 1 is a partial section view of a container with a gas propellant device of this invention in place.

Referring now to the drawing with greater particularity, the gas propelled, liquid dispensing device 10 of this invention includes a low pressure chamber 12 for the gas propellant, which is preferably a gaseous carbon dioxide (CO1) at a moderate pressure of, say 40 to 70 p.s.i. and high pressure vessel 14, which is charged with a liquid or gaseous CO2 or other compressed gas at a pressure of from 500 to 1,000 p.s.i. at 70° Fahrenheit. The high pressure chamber 14 communicates with the low pressure chamber 12 through a central passageway 16 that is normally closed by a pressure reducing, regulator valve 18 carried on a valve stem 20 and sealing against a suitable seat 19.

The valve stem 20 is biased downward to open the valve 18 by a spring 22 acting between a shoulder 24 in the valve body 10, and an adjustment collar 26 carried on the valve stem 20. The adjustment collar 26 may be selectively positioned along the valve stem 20 to adjust the force of the spring 22 that opens the valve 18. Pressure of the gas within the low pressure chamber 12 acts against a flexible diaphragm 28, which is sealed and secured at 29 to a guide 46 for the valve stem 20 to pull the stem 20 upwardly against the spring 22, tending to close the valve 18. Hence, the moderate gas pressure within the chamber 12 may be regulated as desired to a level of, say 40 to 70 p.s.i., by adjustment of the spring 22. When the pressure in the gas chamber 12 falls below the set level, the valve 18 is opened by the spring 22 to admit more gas until the gas pressure acting against the diaphragm 28 is sufficient to again close the valve 18.

It is to be noted that the stem 20 extends out of the pressure chambers 12 and 14 at both ends so that the axial forces acting on the stem 20 remain balanced despite any pressure variations in the liquid CO2 or other compressed gas resulting from temperature variations and, of course, from depletion of the compressed gas.

Before the propellant device 10 is applied to the container 30 for a liquid product L it is charged with highly compressed CO2 or other propellant gas in a manner to be described. A charging nozzle (not shown) is applied to the fill port 32 at the bottom of the unit to introduce liquid CO2 or gas into the interior. Since the charging pressure is at several hundred p.s.i. above the maximum intended pressure of the CO2 or other gas at design temperature, the rubber O-ring 34, which functions as a one-way valve, is forced away from its seat 36, sealing between shoulder 24 and the valve stem 20 to admit the liquid CO2 or other gas. Then, when the high pressure chamber 14 is charged and the charging nozzle is removed, the pressure within the container 14 forces the O-ring 24 back to prevent any outward flow. The introduction of the compressed gas at a pressure several hundred p.s.i. above the designed pressure serves to proof test the device 10 in the course of production line charging.

Figure 2:
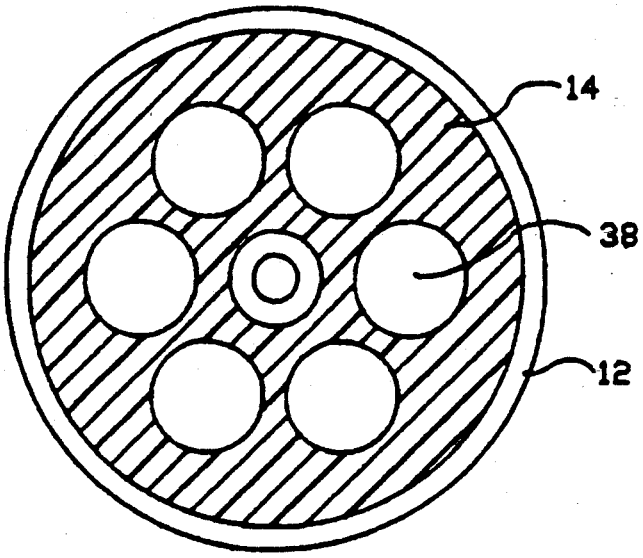
FIG. 2 is a section view taken along line 2—2 of FIG. 1.

The high pressure vessel 14 may be reinforced and encased in a metal jacket or, as shown, it may actually comprise a series of cylindrical chambers 38 molded in a body 14 of plastic or the like, as shown in FIG. 2. A clearance 40 below the cylindrical chambers brings them all into communication for uniform flow past the valve 18. The charging head 42 of the gas propelling valve device 10 has an upper cup 44 that receives the high pressure vessel 14. The discharge head 46 of the unit 10 preferably carries come means such as a threaded cap 45 for attachment of the unit 10 to a conventional liquid container such as a bottle 30. A rupture plate 47 may be provided in the cap 45 so, that in the event of excessive pressure in the bottle 30, as from a leak in the unit 10, the plate 47 will rupture and relieve the non-flammable, nontoxic CO2 gas to the surrounding atmosphere.

Separate liquid product and gas propellant duets 50 and 52 are provided in the discharge head 46. The gas propellant duct 52 opens directly from the low pressure chamber 12 and the liquid product duct 50 opens into communication with a central liquid passageway 54 through the valve stem 20. A dip tube 56 of plastic or the like is attached to the bottom of the valve stem 20 to draw liquid from the bottom of the container through the axial flow passageway 21, and ensure complete evacuation of the container 30.

The spray head actuator 58 has a venturi restriction 60, and a liquid duct 62 opens to the low pressure zone at the restriction. The gas duct 64 opens to the back of the venturi restriction to project a spray of liquid out of the nozzle 66.

Figure 4:
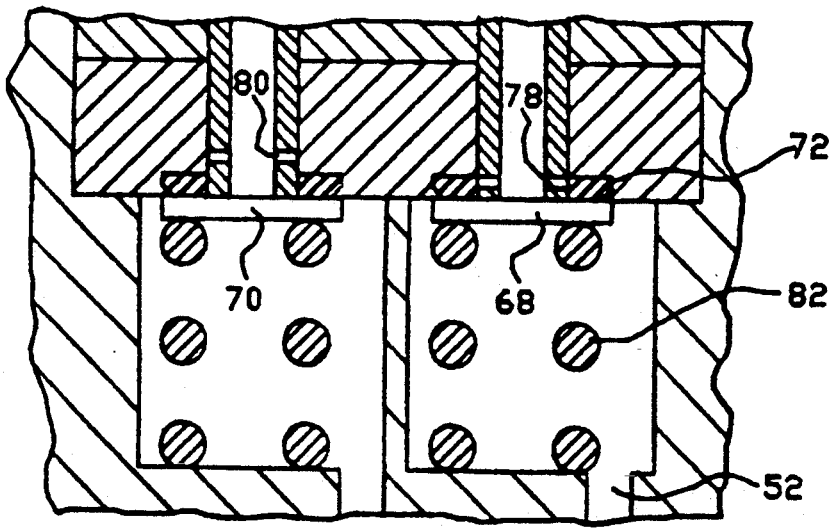
FIG. 4 is an enlarged section view of the discharge head.

When the spray head actuator 58 is depressed, gas and liquid valve members 68 and 70 are moved from their seats 72 so that the tubular actuators 74 and 76 are opened to gas and liquid flow, respectively, through ports 78 and 80. The valves being closed by springs 82. Preferably, the ports 78 and 80 are staggered axially (FIG. 4) so that gas flow begins slightly before liquid flow commences and terminates shortly after liquid flow ceases. This ensures good initial product atomization and complete product evacuation from the nozzle orifice when the spray head actuator is released.

On the other hand the ports 78 and 80 could be staggered so that the port 80 opens first and the liquid flow tube is opened to atmosphere before gas flow draws the liquid L up the tube. This air input would tend to replace the volume of gas previously drawn off and reduce the likelihood of a vacuum being created within the container 10, which might tend to collapse it.

Figure 3:
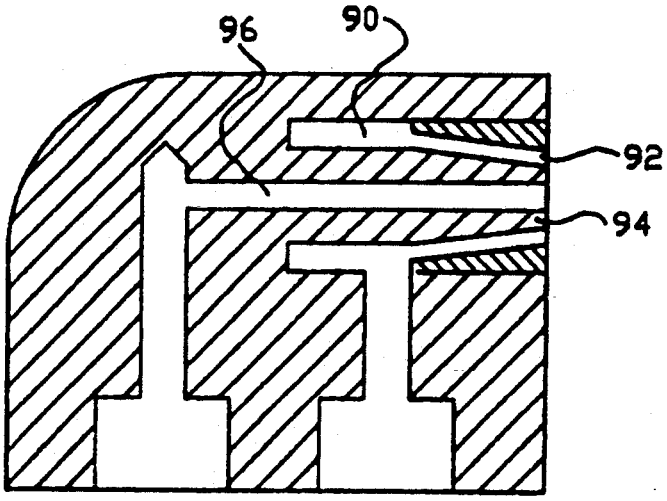
FIG. 3 is an enlarged section view of an alternate form of venturi design.

Referring now to FIG. 3 there is shown an alternate venturi design wherein the gas jet from the chamber 90 exits through an annular nozzle 92 around a central core 94. The liquid product is introduced, to a liquid flow passageway 96 through the core 94 in the center of the annular gas jet.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as an invention is:

1. A gas-propelled dispensing device for a liquid comprising:

a liquid container;

a housing for gas sealed in said container;

said housing including a high pressure chamber and a low pressure chamber;

a pressure reducing valve between said chambers;

a discharge head secured to said container;

means forming a venturi flow passageway in, and opening from, said discharge head;

gas conduit means connecting the inlet end of said venturi flow passageway to said low pressure chamber;

liquid conduit means communicating between the interior of said liquid container and the restriction in said venturi; and valve means selectively operated to open both said conduit means.

2. The gas-propelled dispenser defined by claim 1 wherein:

said valve means are set so that said gas conduit is opened prior to and closed subsequent to said liquid conduit.

3. A gas-propelled dispensing device comprising:

a gas tight housing;

a high pressure chamber and a low pressure gas chamber in said housing;

means forming a port between said chambers;

a pressure-reducing valve operable to close off said port;

a pressure-responsive member exposed to gas in said low pressure chamber;

said pressure-responsive member operable to move said valve toward a closed position in response to increased pressure in said low pressure chamber;

a set spring force member biasing said valve toward an open position;

a recharging inlet passage opening into said high pressure chamber.

a one way check valve in said inlet passage way to enable flow only into said high pressure chamber;

a discharge passage way opening through said housing from said low pressure chamber; and a manual operating discharge valve normally closing said discharge passage way opening.

4. The gas-propelled dispensing device defined by claim 3 including:

means on said housing around said discharge passageway for securing said housing to a liquid container.

5. The gas-propelled dispensing device defined by claim 3 including:

a nozzle;

a gas outlet line from said gas discharge valve to said nozzle;

a liquid outlet line opening from said housing to said nozzle;

a liquid outlet valve to close off said liquid outlet line; and a liquid feed conduit connecting said liquid outlet valve to a source of liquid.

6. The gas-propelled dispensing device defined by claim 5 wherein:

said valve stem extends upward from said pressure-reducing valve into said low pressure chamber to be secured and sealed to said pressure-responsive member;

an extension of said valve stem extending through said recharging inlet port through said one-way check valve; and said liquid feed conduit extends axially through said valve stem.

7. The gas-propelled dispensing device defined by claim 5 including:

a venturi restriction in said nozzle;

said gas outlet line opening to one end of said venturi restriction.

8. A gas-propelled dispensing device for a liquid in a container comprising:

a discharge head adapted to be secured to a container to seal off an opening therein;

a low pressure gas vessel depending from and carried by said discharge head;

a gas duct connecting said discharge head to said low pressure gas vessel;

a liquid flow tube carried by said discharge head to extend therebelow;

a liquid duct connecting said discharge head to said liquid flow tube;

liquid and gas discharge valves to close off said liquid and gas ducts, respectively;

spring means biasing said discharge valves to closed positions;

said discharge valves being opened by predetermined movement of said discharge head;

said gas and liquid ducts opening into a venturi passageway;

a high pressure vessel carried by said discharge head;

a gas recharge duct connecting said high pressure vessel to said low pressure vessel; and a pressure reducing regulator valve normally closing said gas recharge duct.

9. A gas-propelled dispenser as defined in claim 8 wherein: said liquid duct opens into low pressure zone of said venturi passage way created by flow of said gas.

10. The gas-propelled dispensing device defined by claim 8 including:

spring means biasing said pressure reducing regulator valve opened by a predetermined force;

a pressure-responsive member exposed to gas in said low pressure vessel to bias said pressure reducing regulator valve to a closed position.

11. The gas-propelled dispensing device defined by claim 8 including:

a charge of highly compressed gas in said high pressure vessel as a source of gas for said low pressure gas vessel.

12. The gas-propelled dispensing device defined by claim 11 including:

a charging port for said highly compressed gas opening into said high pressure vessel; and a one-way check valve in said charging port enabling flow only into said high pressure vessel through said port.

13. The gas-propelled dispensing device defined by claim 11 wherein:

said high pressure vessel comprises a body with a plurality of generally cylindrical compartments formed therein;

said compartments being in joint communication with said regulator valve.

* * * * *